US007429146B2

(12) United States Patent
Hall et al.

(10) Patent No.: US 7,429,146 B2
(45) Date of Patent: Sep. 30, 2008

(54) HIGHWAY MARKING SPHERE DISPENSING APPARATUS

(75) Inventors: Kevin E. Hall, Allen Park, MI (US); Christopher Davies, Waldwick, NJ (US); Thomas Still, Campbell, TX (US); Keith Wolos, Pequannock, NJ (US); Kenneth Grimbilas, Pompton Plains, NJ (US)

(73) Assignee: Potters Industries, Inc., Berwyn, PA (US)

( * ) Notice: Subject to any disclaimer, the term of this patent is extended or adjusted under 35 U.S.C. 154(b) by 0 days.

(21) Appl. No.: 11/148,539

(22) Filed: Jun. 9, 2005

(65) Prior Publication Data

US 2006/0278737 A1 Dec. 14, 2006

(51) Int. Cl.

| | |
|---|---|
| ***E01C 23/16*** | (2006.01) |
| ***E01C 17/00*** | (2006.01) |
| ***G01F 11/00*** | (2006.01) |
| *E01C 7/35* | (2006.01) |

(52) U.S. Cl. ..... 404/93; 404/94; 222/1; 239/455

(58) Field of Classification Search ..... 404/93, 404/94; 222/1; 239/455

See application file for complete search history.

(56) References Cited

U.S. PATENT DOCUMENTS

| | | | | | |
|---|---|---|---|---|---|
| 2,673,090 | A | * | 3/1954 | Blumberg | 239/654 |
| 2,691,923 | A | * | 10/1954 | Huck | 404/94 |
| 2,756,103 | A | * | 7/1956 | Creswell | 239/578 |
| 3,286,605 | A | * | 11/1966 | Wilson et al. | 404/94 |
| 3,682,054 | A | * | 8/1972 | MacPhail et al. | 239/130 |
| 3,790,030 | A | * | 2/1974 | Ives | 222/135 |
| 3,967,784 | A | | 7/1976 | Ammon | |
| 4,058,136 | A | * | 11/1977 | Falk | 137/110 |
| 4,518,121 | A | | 5/1985 | Smith | |
| 4,523,789 | A | | 6/1985 | Schwarz | |
| 4,548,652 | A | | 10/1985 | Kelly et al. | |
| 4,873,925 | A | * | 10/1989 | Hultberg et al. | 101/147 |
| 4,877,348 | A | * | 10/1989 | Opie | 404/93 |
| 4,887,741 | A | * | 12/1989 | Downing | 222/146.5 |

(Continued)

FOREIGN PATENT DOCUMENTS

| | | |
|---|---|---|
| EP | 1 389 651 | 2/2004 |

(Continued)

OTHER PUBLICATIONS

International Search Report, dated Oct. 6, 2006.

*Primary Examiner*—Raymond W Addie
(74) *Attorney, Agent, or Firm*—Ratner Prestia

(57) ABSTRACT

A marking sphere dispensing apparatus for dispensing fluid-assisted marking spheres into pavement marking materials applied to a surface has a frame defining a marking sphere receptacle, a valve seat defining an opening between the marking sphere receptacle and an expulsion duct. A plunger is disposed coaxially to the longitudinal axis of the dispensing apparatus and defines an internal fluid passage for providing pressurized fluid. The plunger is moveable in a longitudinal direction within the marking sphere dispensing frame between a first position at which a plunger head of the plunger is seated against the valve seat to close the opening, and a second position at which the plunger head is axially offset from the valve seat to define a marking sphere inlet gap across the opening. A method for applying marking spheres uses the marking sphere dispensing apparatus.

21 Claims, 8 Drawing Sheets

U.S. PATENT DOCUMENTS 5,002,208 A * 3/1991 Towery ..... 222/438
5,192,178 A * 3/1993 Silbernagel ..... 414/523
5,368,232 A 11/1994 Schroeder
5,947,385 A 9/1999 Lanerd et al.
6,170,537 B1 * 1/2001 Lasserre ..... 141/3
6,478,507 B2 11/2002 Schroeder et al.
6,511,259 B1 1/2003 Khieu et al.
6,824,012 B2 11/2004 Werner
2005/0013652 A1 * 1/2005 Corbosiero ..... 401/289

FOREIGN PATENT DOCUMENTS

EP 1389651 2/2004
WO WO 01/42566 6/2001

* cited by examiner

HIGHWAY MARKING SPHERE DISPENSING APPARATUS

FIELD OF THE INVENTION

This invention is directed to a system for dispensing and applying granulated materials onto a surface while the dispenser is moving relative to the surface, and more particularly, a highway marking sphere dispenser mounted on a moving vehicle for dispensing marking spheres onto a road surface substantially at the same time as a pavement marking material is applied to the road surface to enhance the reflectance properties of the pavement marking material.

BACKGROUND OF THE INVENTION

Pavement marking or pavement striping is conducted by applying paints, resins, reflective materials, and/or reflective media onto streets, roads, or parking lots. These markings serve a variety of purposes: they demarcate roadway lane boundaries, identify where it is appropriate to pass cars traveling in the same lane of traffic, identify where pedestrians are permitted to cross a street or intersection, identify where it is or is not appropriate to park a vehicle in a parking lot, and indicate restrictions and permissions on lane usage. These markings must be clearly visible in both daylight hours and in the less than optimal conditions, such as during twilight or evening hours. Moreover, these markings must be visible even under wet conditions and be able to withstand constant wear from vehicle and pedestrian traffic.

Although advancement has been made to increase the visibility of paints, current standards find the reflective quality of paint less than adequate. One solution to increase the reflectance quality of paints is to incorporate a reflective material within the paint as it is applied to the pavement surface. This technique may also be useful for resins (e.g. thermoplastics or epoxies) and tapes which may contain reflective materials called retroreflectors. Retroreflectors are devices that send light or other radiation back where it came from regardless of the angle of incidence, unlike a mirror, which does so only if the mirror is exactly perpendicular to the light beam. Retroreflectors produce the effect of retroreflection (also called retroflection) and possess retroreflectivity characteristics. One such retroreflector is a highway marking sphere, e.g. a glass bead, having a refractive index of at least 1.5. Each marking sphere behaves like a spherical lens reflecting multiple angled incident light back to the motorist. When light from a vehicle headlight enters the marking sphere, it travels through the marking sphere, strikes the pavement marking material, and is reflected back toward the source from which the light originated, i.e., the driver of the vehicle. In this manner, in the pavement marking material, e.g. the paints, tapes or resins, reflectance qualities are increased and make it easier for drivers to see these pavement markings at nighttime.

Incorporation of marking spheres into paints and resins while maintaining the retroreflectivity of a highway marking has its challenges. With paints and resins, marking spheres can be mixed into the paint or resin before application, or the marking spheres can be applied just after the paint is applied to the highway. Of these incorporation techniques, the latter technique is generally preferred because the marking spheres are adhered to the pavement marking material, but not embedded completely below the surface of the pavement marking material. This application technique allows the marking spheres to be present at the surface of the pavement marking material where retroreflectivity of the applied highway marking can be immediately utilized.

That is to say, other techniques have certain disadvantages. For example, marking spheres mixed into the paint or resin before application tend to have marking spheres within the layer of paint or resin as it is applied on the pavement surface. These embedded marking spheres are not easily removed from the pavement marking surface, but also cannot be immediately utilized. They can be subsequently utilized after the top layer of pavement marking material is worn away from vehicle traffic or weather.

A typical device to dispense marking spheres just prior to application is a marking sphere dispenser. A marking sphere dispenser is typically located on a movable vehicle that also carries the paint or resin applicator, so that an appropriate quantity of marking spheres are dispensed onto the width of the pavement marking in accordance with predetermined marking characteristics. The vehicle carrying the marking sphere dispenser is generally moving while the pavement marking materials and marking spheres are applied to the pavement surface. Therefore, if the marking spheres are simply dropped directly onto the pavement marking material as the pavement marking material is applied, the relative velocity of the marking spheres approximates the velocity at which the vehicle is moving over the pavement.

The relative marking sphere velocity is responsible for a phenomenon called marking sphere rolling. It is typically seen that applying marking spheres from a vehicle traveling less than about 8 mph does not result in any significant marking sphere roll. At these speeds, the amount of road surface covered in a day is meager. There is a desire therefore to increase the application speeds, but application speeds above 8 mph are problematic in that these speeds impart a significant relative velocity to the marking sphere. The relative velocity at which the marking spheres strike the pavement marking material on the road surface can cause the marking spheres to roll along the pavement marking material in the direction of vehicle travel after initially striking the pavement marking material despite the tackiness of the pavement marking material. As the marking spheres roll, they pick up some of the pavement marking material on their surface, which prevents that portion of the marking sphere from reflecting light. To reduce marking sphere roll, the marking sphere dispenser may be positioned so that the marking spheres are ejected from the marking sphere dispensing device having a vector opposite the vector of vehicle travel. This opposing marking sphere vector cancels some or all of the relative velocity of the marking spheres and reduces rolling.

Marking sphere roll becomes more problematic by the continuing drive to apply the pavement marking materials and marking spheres at faster speeds so that the vehicles carrying the pavement marking devices minimally impact traffic conditions. As is understood, the faster the vehicle moves in one direction, the faster the marking spheres must travel in the opposite direction to reduce marking sphere roll. In this regard, some marking sphere dispensing devices impart a velocity to the marking spheres with pressurized fluid in a direction opposite to the direction of travel of the vehicle.

SUMMARY OF THE INVENTION

The present invention is directed to a marking sphere dispensing apparatus having a frame and a valve seat defining an opening between a marking sphere receptacle and an expulsion duct. Within the marking sphere dispensing apparatus is a plunger having a plunger head at one end and moveable in a longitudinal direction within the frame between a first position at which the plunger head is seated against the valve seat to close the opening, and a second position at which the plunger head is axially offset from the valve seat to define a marking sphere inlet gap across the opening. The plunger defines an internal fluid passage extending along the length of the plunger for providing a fluid flow and having an outlet at the plunger head.

A method for applying highway marking spheres onto a substrate with a marking sphere dispensing apparatus of the present invention includes supplying a pressurized flow of marking spheres into a marking sphere receptacle having a valve seat defining an opening between the marking sphere receptacle and an expulsion duct. According to an exemplary embodiment, a pressurized flow of compressed air is supplied through an internal passage of a plunger having a plunger head seated, in a first position, against the valve seat at which is disposed an internal passage outlet. The plunger head is axially offset from the valve seat into a second position of the plunger to form a marking sphere inlet gap across the opening causing the marking spheres to mix with the pressurized air and be expelled from the marking sphere receptacle into the expulsion duct.

BRIEF DESCRIPTION OF THE DRAWINGS

The invention is best understood from the following detailed description when read in connection with the accompanying drawings.

DETAILED DESCRIPTION OF THE INVENTION

Figure 1:
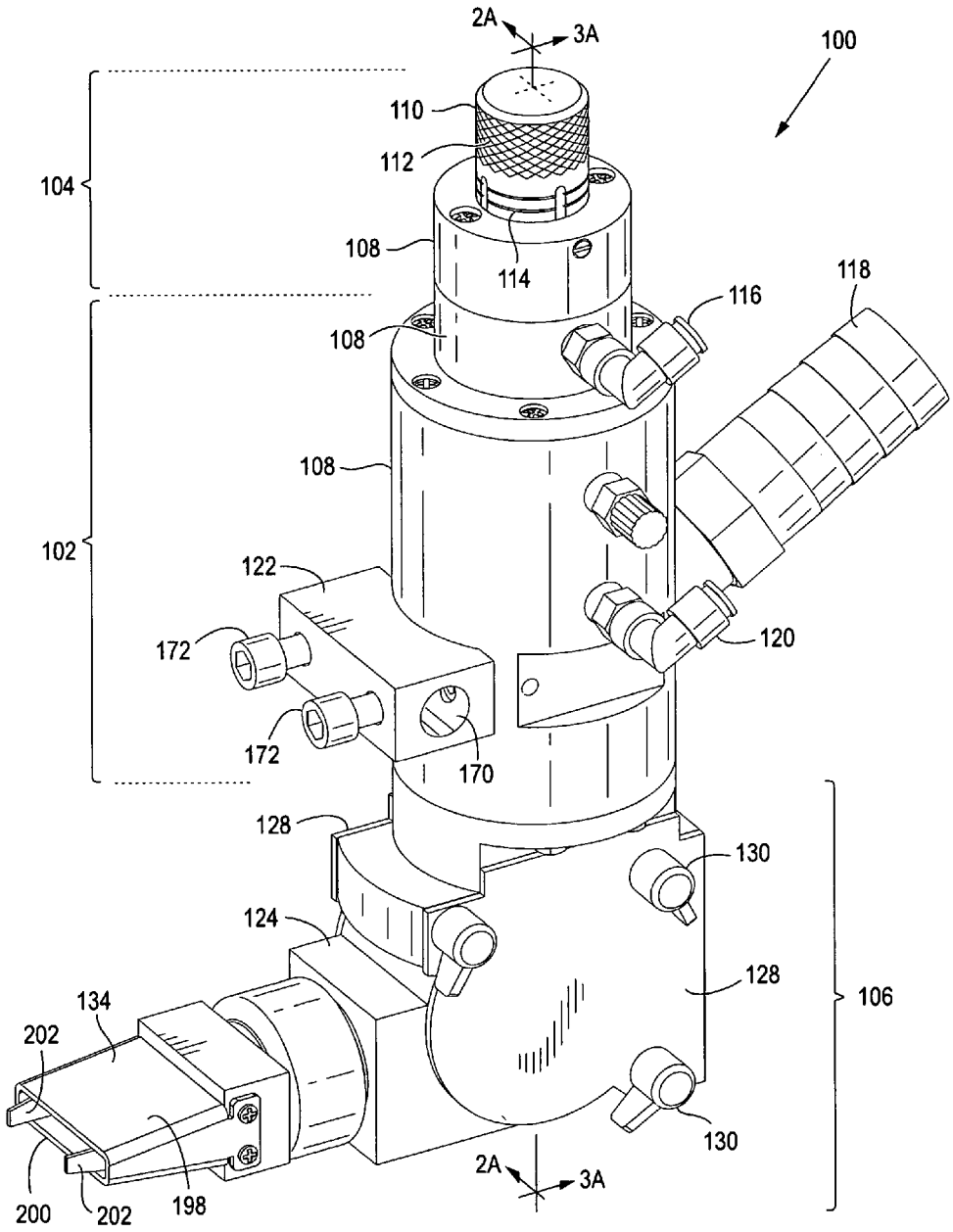
FIG. 1 is a perspective view of a marking sphere dispensing apparatus according to an embodiment of the present invention.

Referring now to the drawings, in which like reference numbers refer to like elements throughout the various figures that comprise the drawings, FIG. 1 is a perspective view of a marking sphere dispensing apparatus according to an embodiment of the present invention.

As used throughout, the term "fluid" (except in the context of "fluid communication") contemplates any liquid or gas that is capable of flowing and which conforms to the outline of its container. According to an exemplary embodiment of the present invention, the fluid may be pressurized or compressed atmospheric air. For ease of discussion, marking sphere dispensing apparatus 100 is separated into portions: a main body portion 102, an adjustment portion 104, and a dispensing portion 106.

Adjustment portion 104 is defined by a frame 108 and has a control knob 110 which adjusts the amount of marking spheres traveling through marking sphere dispensing apparatus 100. Control knob 110 is shown in FIG. 1 as having a textured appliqué 112 on its side. Also shown on control knob 110 are multiple indicia or detents 114. Indicia or detents 114 may serve as a visual and/or physical indication of the size of an opening through which the marking spheres travel, discussed in more detail with respect to FIG. 2.

Figure 5:
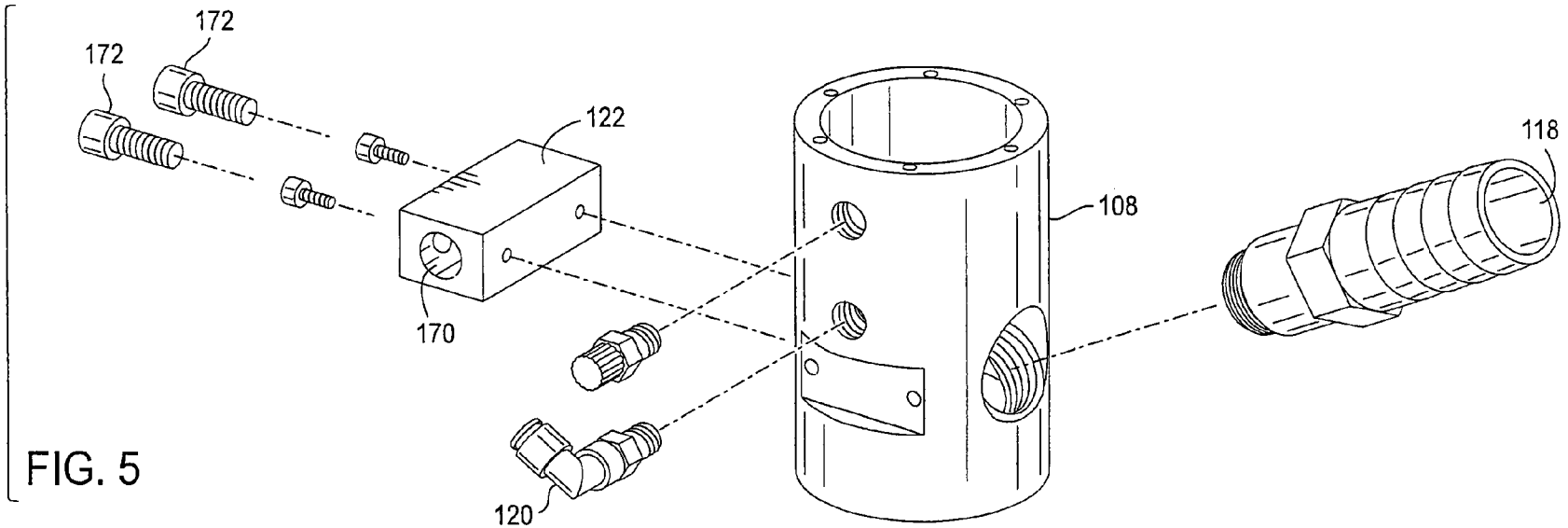
FIG. 5 is an exploded perspective view of a mounting block, activation fluid inlet nozzle, and marking sphere inlet of the embodiment of the marking sphere dispensing apparatus as shown in FIG. 1.

Adjacent adjustment portion 104, is main body portion 102 of marking sphere dispensing apparatus 100. Main body portion 102 includes frame 108 which houses an activation chamber and a marking sphere receptacle (not shown in FIG. 1). As shown in the embodiment of FIG. 1 attached to frame 108 is an inlet for an internal fluid passage 116, a marking sphere inlet 118, an activation chamber (not shown), a pressurized fluid activation chamber inlet 120, and a mounting block 122. FIG. 5 shows an exploded perspective view of the components forming main body portion 102 discussed later in more detail. Referring again to FIG. 2, inlet for an internal fluid passage 116 and pressurized fluid activation chamber inlet 120 have connectors for releasably securing a fluid supply line. Such connectors include, but are not limited to, threaded connectors, quick release connectors, hoses and clamps, and hoses and variable-sized barb connectors. Alternatively, fluid supply lines connected to inlet for an internal fluid passage 116 and pressurized fluid activation chamber inlet 120 may be fixedly attached.

Figure 7:
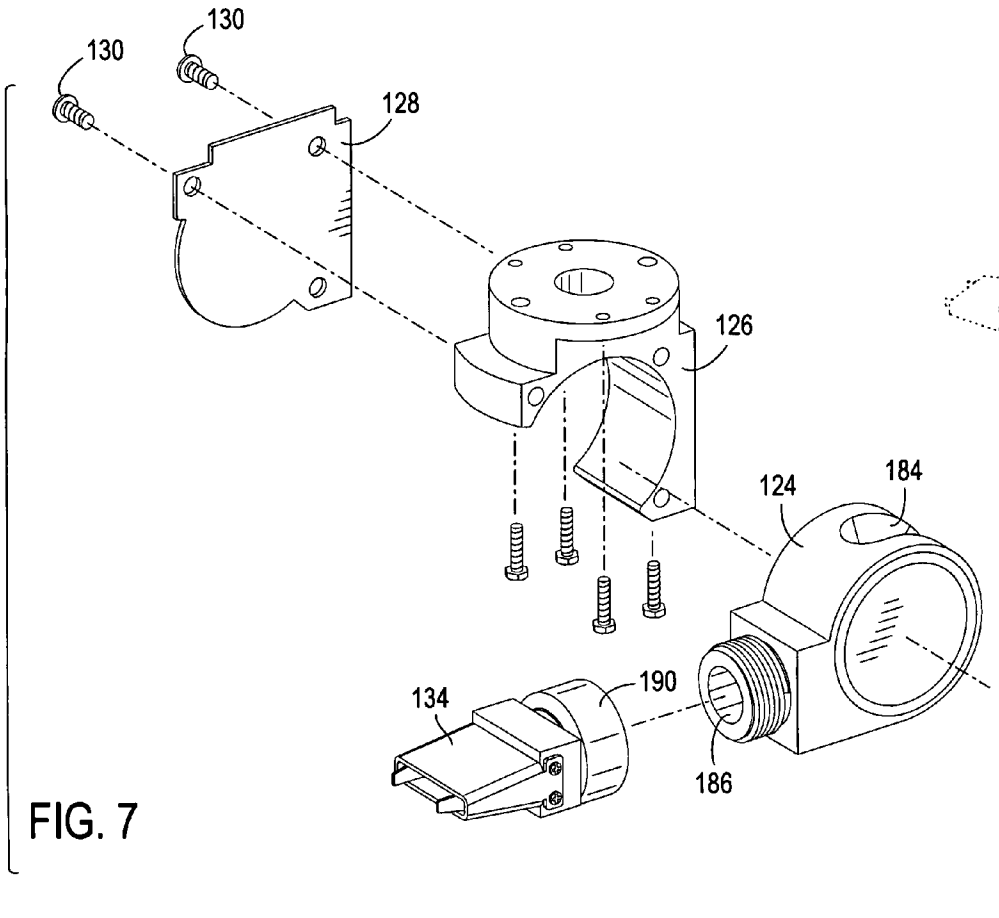
FIG. 7 is an exploded perspective view of a flow diverter of the embodiment of the marking sphere dispensing apparatus shown in FIG. 1.

Adjacent main body portion 102 is a dispensing portion 106. Dispensing portion 106 has an expulsion duct 132 (not shown in FIG. 1) to receive a pressurized fluid flow and marking sphere mixture (a fluid-assisted marking sphere mixture) from a marking sphere receptacle 174 (also not shown in FIG. 1). The expulsion duct 132 is in fluid communication with a flow diverter 124. The expulsion duct 132 and flow diverter 124 are supported and maintained by expulsion duct frame 126 which includes side plates 128 and mounting bolts 130. An exploded view of expulsion duct frame 126 and flow diverter 124 are shown in FIG. 7. Connected to flow diverter 124 is a discharge funnel 134, discussed in more detail below with reference to FIG. 9.

Figures 2A, 2B:
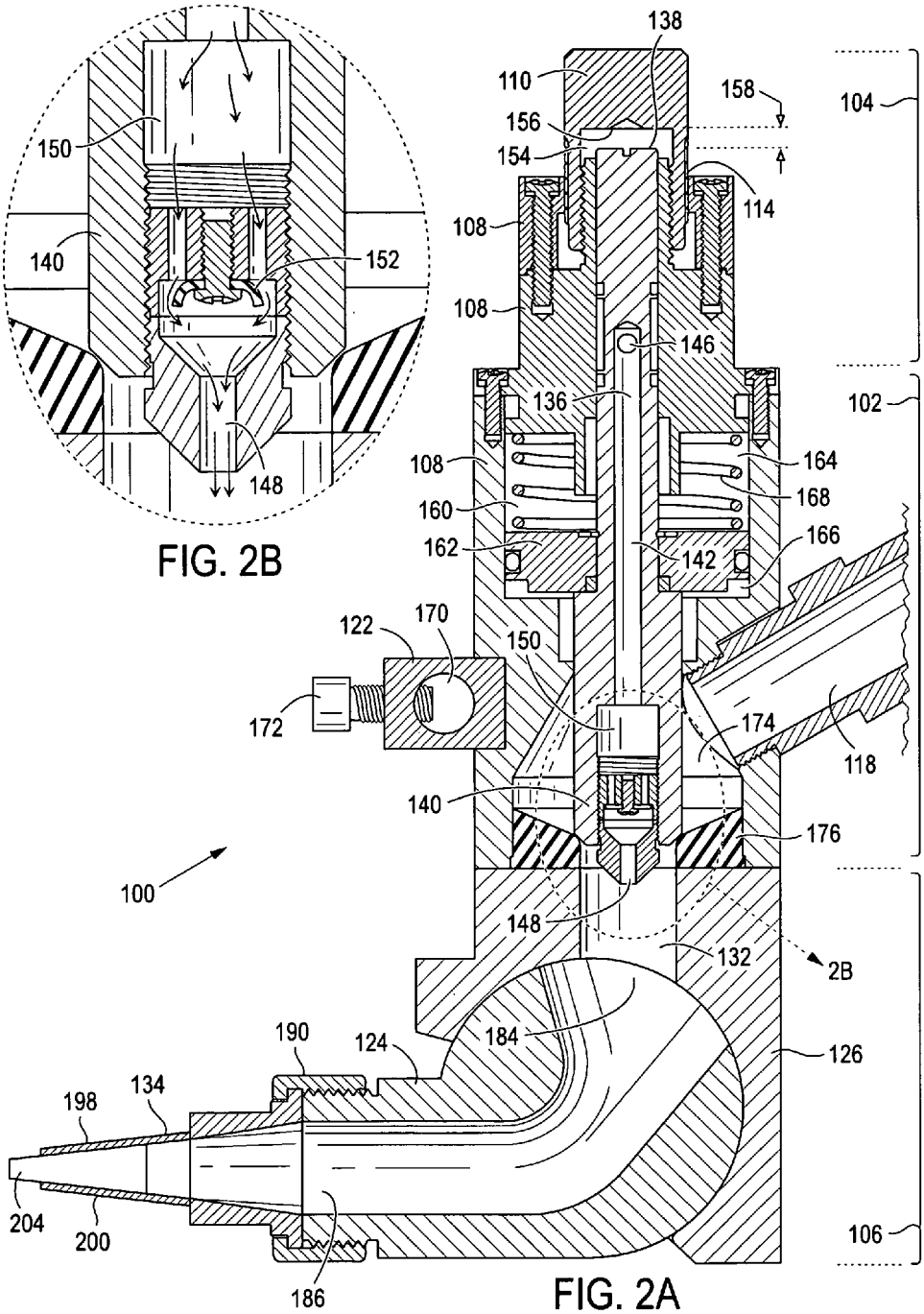
FIG. 2A is a cross-sectional plane view along line 2A-2A of the marking sphere dispensing apparatus shown in FIG. 1.
FIG. 2B is an enlarged, detailed view of a check valve of a plunger head of the marking sphere dispensing apparatus shown in FIG. 1.
Figure 3A:
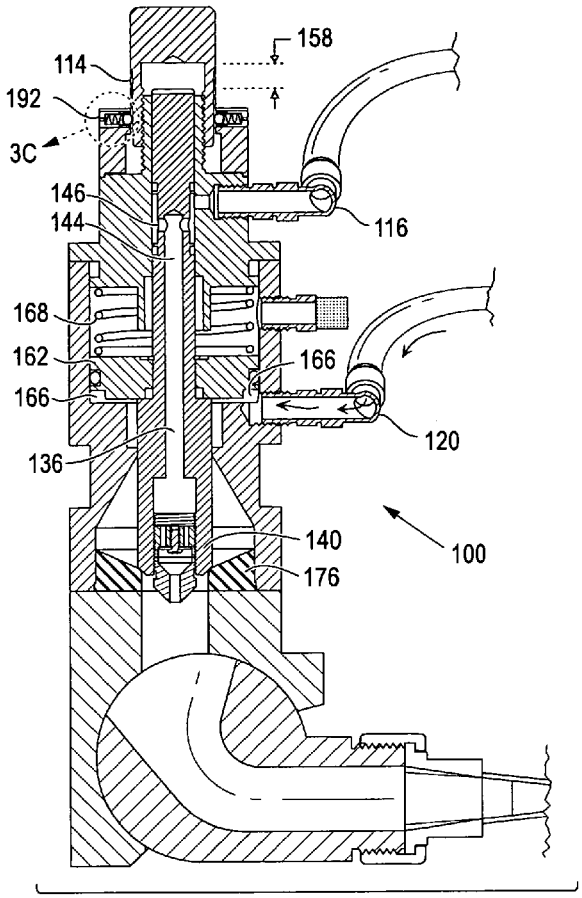
FIG. 3A is a mixed cross-sectional view showing adjustment and main body portion along line 3A-3A of FIG. 1 and the dispensing portion shown along line 2A-2A of FIG. 1.

FIG. 2A is a cross-sectional view along line 2A-2A of marking sphere dispensing apparatus 100 shown in FIG. 1 illustrating the internal components of each portion of marking sphere dispensing apparatus 100. Extending from adjustment portion 104 through main body portion 102 is a plunger 136. Plunger 136 is moveable in a longitudinal direction within marking sphere dispensing apparatus 100 between a first position (as shown in FIGS. 2A and 3A) and a second position (as shown in FIG. 3B). Where plunger 136 extends to adjustment portion 104, plunger 136 has a blunt end 138. At main body portion 102, plunger 136 has a plunger head 140 shown in more detail in FIG. 2B. Between blunt end 138 and plunger head 140 is plunger shaft 142. Plunger shaft defines an internal pressurized fluid passage 144 (not shown in FIG. 2A) having an inlet 146 near the plunger blunt end 138. Plunger head 140 defines an outlet 148 of internal pressurized fluid passage 144.

FIG. 2B is an enlarged, detail view of plunger head 140 of the embodiment of the marking sphere dispensing apparatus 100 shown in FIG. 1. Disposed at outlet 148 of internal pressurized fluid passage 144 is a nozzle 150. Nozzle 150 has external threads to engage a threaded interior of pressurized fluid passage outlet 148. At outlet 148 of nozzle 150, is disposed a check valve 152 to prevent marking spheres from traveling up internal fluid passage 144 of plunger shaft 142.

Figure 3B:
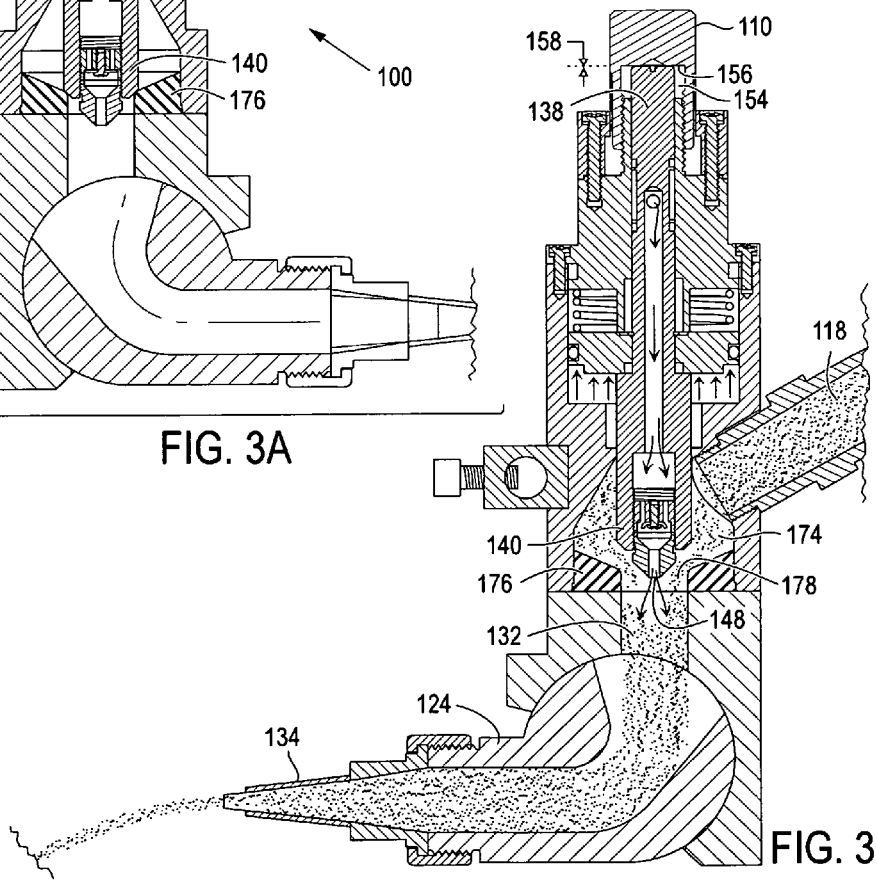
FIG. 3B is a cross-sectional view along line 2A-2A of the marking sphere dispensing apparatus shown in FIG. 1 illustrated with marking sphere-flow and arrows to show direction of fluid flow.
Figure 4:
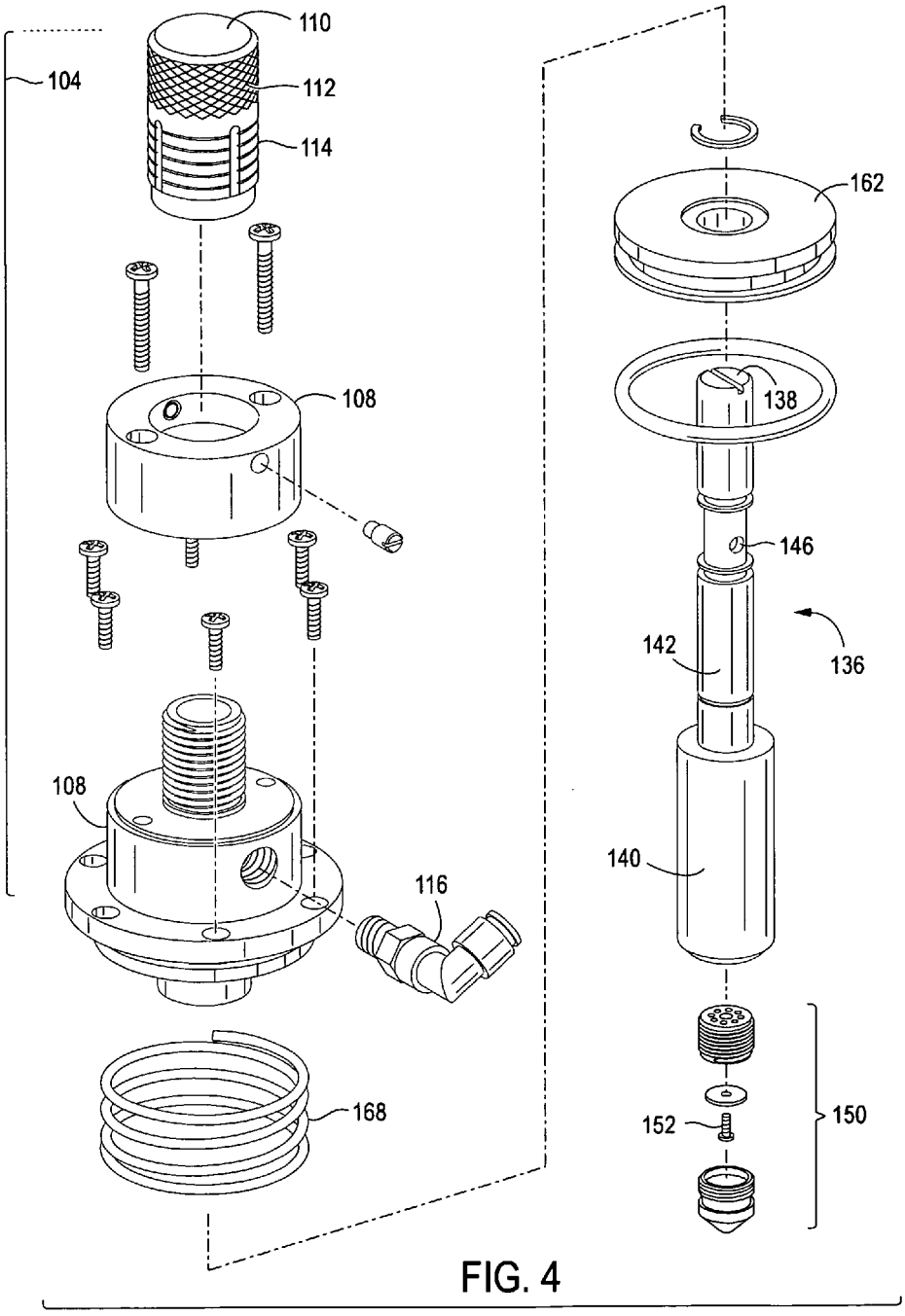
FIG. 4 is an exploded perspective view illustrating the coaxial relationship of a control knob, plunger crown, and plunger of the marking sphere dispensing apparatus as shown in FIG. 1.

Referring back to FIG. 2A, in adjustment portion 104, control knob 110 defines a partial bore 154 with an internal base 156 having internal threads which engage a threaded portion of frame 108. Control knob 110 is shown in more detail in FIG. 4. Between base 156 of control knob partial bore 154 and plunger blunt end 138 is a stop gap distance 158 which defines a distance between a first and second position of plunger 136. As plunger 136 moves in a longitudinal direction within frame 108 of marking sphere dispensing device 100, base 156 of control knob bore 154 prohibits plunger 136 from moving when plunger blunt end 138 contacts base 156 of control knob bore 154. In this manner, control knob 110 and stop gap distance 158 define the range of longitudinal motion of plunger 136. When stop gap distance 158 is defined by its maximum distance between plunger blunt end 138 and base 156 of control knob bore 154, plunger 136 is at its first position as shown in FIGS. 2A and 3A. When plunger blunt end 138 contacts base 156 of control knob bore 154, plunger 136 is at its second position as shown in FIG. 3B. To adjust stop gap distance 158 and the range of longitudinal movement of plunger 136, control knob 110 is rotated to widen or lessen stop gap distance 158. For a visual indication of stop gap distance 158, control knob exterior includes indicia/indents 114. Although limiting the longitudinal movement of plunger 136 is shown by control knob 110, other suitable stops as would be understood to one having ordinary skill in the art which are consistent with the purpose of control knob 110 are contemplated by this invention.

In main body portion 102 shown in FIG. 2A, frame 108 defines an activation chamber 160. Activation chamber 160 has a center coaxial with the longitudinal axis of plunger 136 so that plunger 136 extends through activation chamber 160. Disposed within activation chamber 160 is a plunger crown 162 fixedly attached to plunger shaft 142. Plunger crown 162 bifurcates activation chamber 160 into a first 164 and a second 166 portion. First portion of activation chamber 164 houses a tension spring 168 that applies pressure against plunger crown 162 and decreases the volume of second portion of activation chamber 166 when plunger 136 is at its first position. The coaxial relationship of plunger 136 with ball plunger 162, tension spring 168, and control knob 110 is more clearly seen in the longitudinally exploded view of FIG. 4. Referring again to FIG. 2A, second portion of activation chamber 166 is in fluid communication with pressurized fluid activation chamber inlet 120, shown in FIG. 3A, but not in FIG. 2A.

Connected to the exterior of frame 108 at main body portion 102 is a mounting block 122. Mounting block 122 is shown as defining a through hole 170 through which is engaged a rod member (not shown) secured by mounting bolts 172. Mounting block 122 is responsible for securing marking sphere dispensing apparatus to a vehicle, carriage (which may be affixed to the vehicle), or additional vehicle framing. Although shown as a single mounting block 122 at main body portion 102, other suitable mounting apparatus in number, type, and location on the marking sphere dispensing apparatus that would be contemplated by one having ordinary skill in the art form part of this invention.

Frame 108 at main body portion 102 defines a marking sphere receptacle 174 which has a marking sphere inlet 118 for receiving a flow of pressurized marking spheres. Frame 108 and marking sphere receptacle 174 define a valve seat 176 defining an opening 178 (shown in FIG. 3B) between marking sphere receptacle 174 and expulsion duct 132. Plunger 136 with plunger head 140 and expulsion duct 132 are disposed coaxially with each other and coaxially with a longitudinal axis of marking sphere receptacle 174. In this embodiment of marking sphere dispensing apparatus 100, fluid flow supplied through internal fluid passage 144 of plunger 136 exits at plunger head 140 through nozzle 150 and flows into expulsion duct 132 at a substantially vertically downward and linear flow path direction.

Plunger 136 shown in FIG. 2A is at its first position at which plunger head 140 is seated against valve seat 176 to close opening 178 between marking sphere receptacle 174 and expulsion duct 132. When plunger 136 is at its first position, the pressurized fluid supplied through internal fluid passage 144 of plunger 136 exits plunger head nozzle 150 and is directed to expulsion duct 132. Plunger head 140 prevents the marking spheres in marking sphere receptacle 174 from mixing with the fluid flow and flowing into expulsion duct 132. Plunger 136 is maintained at its first position because tension spring 168, housed by first portion of activation chamber 164, applies pressure against a plunger crown 162 to seat plunger head 140 against valve seat 176.

Valve seat 176 is constructed of a material having sufficient pliability such that if an individual marking sphere becomes lodged between valve seat 176 and plunger head 140 when plunger 136 is at its first position, the valve seat material conforms around the marking sphere and maintains a seal with plunger head 140 to prevent other marking spheres from flowing onto expulsion duct 132. Suitable materials include those materials having a Shore A scale (measured with a durometer) hardness value between about 50 and about 90, and more preferably between about 55 and about 60. Suitable materials having the appropriate hardness values include, but are not limited to, rubber and plastics, such as polyurethanes. The surface of valve seat 176, marking sphere receptacle 174, expulsion duct 132, and flow diverter 124 may also be coated with a material to encourage the flow of the pressurized marking spheres and decrease electrostatic charges. Such coatings include, but are not limited to, acrylonitrile-butadiene styrene (ABS), fluorocarbons (such as polytetrafluoroethylene, e.g. Teflon®, and tetrafluorethylene), polyamides (such as Nylon®, Durethan®, and Zytel®), polycarbonates (such as Baylon®, Lexan®, Merlon®, and Nuclon®), polypropylene (such as Bexphane®), polystyrene, and polyester.

Figure 8:
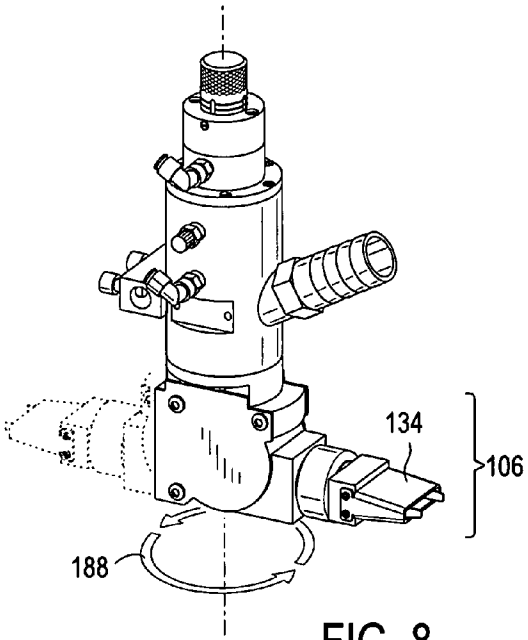
FIG. 8 is a perspective view illustrating the rotational movement of a flow diverter about the vertical axis of the marking sphere dispensing apparatus shown in FIG. 1.

Connected to main body portion 102 is dispensing portion 106. Dispensing portion 106 includes expulsion duct 132, flow diverter 124, and discharge funnel 134. Expulsion duct 132 is maintained in fluid communication with opening 178 defined by frame 108 and marking sphere receptacle valve seat 176. Flow diverter 124 is in fluid communication with expulsion duct 132 at an inlet end 184 and is releasably attached to discharge funnel 134 at an outlet end 186. As shown in FIG. 8, the entirety of dispensing portion 106 is capable of rotation about the longitudinal axis of marking sphere dispensing apparatus 100 as shown by arrow 188 in a full 360° range of motion or according to one embodiment, for a full 360° range of motion at 45° intervals. As discussed in more detail with respect to FIGS. 6A, 6B, 6C and 8, flow diverter 124 is also capable of pivoting within expulsion duct frame 126. Referring again to FIG. 2A, flow diverter inlet end 184 has an opening with a diameter that is substantially wider than the diameter of expulsion duct 132. The wider diameter of flow diverter inlet end 184 accommodates continuous fluid communication with expulsion duct 132 when flow diverter 124 is pivoted.

Outlet end of flow diverter 186 is releasably connected to discharge funnel 134 by way of a threaded funnel clamp 190. The pivot angle of flow diverter 124 from the longitudinal axis of marking sphere dispensing apparatus 100 and configuration of discharge funnel 134 shapes the spray pattern, direction, and angle that the fluid-assisted marking sphere mixture exits the dispensing apparatus 100 and strikes the pavement marking material and road surface.

FIG. 3A is a mixed cross-sectional plane view with the adjustment portion 104 and main body portion 102 shown along line 3A-3A of the marking sphere dispensing apparatus 100 shown in FIG. 1 and dispensing portion 106 shown along line 2A-2A of FIG. 1. More precisely, the dispensing portion is rotated 90° with fluid passage inlet 166 and activation chamber fluid inlet 120 are rotated a quarter turn. With this view, it is possible to see that internal fluid passage inlet 116 is in fluid communication with internal fluid passage 144 of plunger 136 when plunger 136 is either at its first or second positions. For example, when plunger 136 is at its first position, a stream of fluid exits plunger head nozzle 150 even though marking spheres are not mixed with the fluid flow from internal fluid passage 144. It is also possible to see that activation chamber fluid inlet 120 is in fluid communication with second portion 166 of activation chamber 160.

Figure 3C:
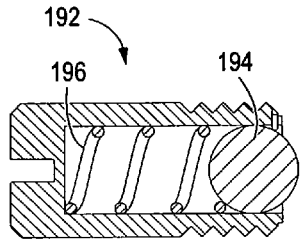
FIG. 3C is an enlarged, detail view of an embodiment of a ball plunger of the marking sphere dispensing apparatus shown in FIG. 3A.

Also illustrated in FIG. 3A, but shown as an enlarged, detail view in FIG. 3C, is a ball plunger 192. Ball plunger 192 houses a bearing 194 and a bearing spring 196. Bearing spring 196 applies a force against bearing 194 that releasably engages detents/indicia 114 on the exterior surface of control knob 110. Therefore, indicia/detents 114 and ball plunger 192 provide both a visual and palpable mechanism by which stop gap distance 158 is measured. Ball plunger 192 also provides a frictional and releasable locking mechanism to prevent control knob 110 from rotating because of vibrational forces caused by the application vehicle to which the marking sphere dispensing apparatus 100 is attached.

FIG. 3B is a cross-sectional plane view along line 2A-2A of marking sphere dispensing apparatus shown in FIG. 1 illustrating plunger 136 at its second position and showing marking spheres injected into dispensing apparatus 100 and arrows to indicate direction of fluid flow. As shown in FIG. 3B, when plunger 136 is at its second position, pressurized fluid, introduced into second portion 166 of activation chamber 160, applies pressure against plunger crown 162 to compress tension spring 168 to axially offset plunger 136. As the pressurized fluid moves plunger crown 162 to compress tension spring 168, plunger head 140 is concurrently axially offset from valve seat 176 thereby defining a marking sphere inlet gap across opening 178. FIG. 3B also includes arrows to illustrate the flow of pressurized fluid in second portion of activation chamber 166 and fluid flow through internal fluid passage 144 of plunger shaft 142. As shown in FIG. 3B, when plunger 136 is at its second position, plunger head 140 is axially offset from valve seat 176 of marking sphere receptacle 174 and defines a marking sphere inlet gap opening 178. At second position, the fluid flow expelledfrom the internal fluid passage outlet 148 at plunger head 140 combines with the marking spheres from marking sphere receptacle 174 to form a marking sphere fluid flow mixture, which mixture flows across marking sphere Inlet gap opening 176 into expulsion duct 132. The marking sphere fluid mixture flow is assisted by pressurized fluid that increases the velocity of the mixture through expulsion duct 132, flow diverter 124, and discharge funnel 134. As illustrated in FIG. 3B, the fluid flow and the marking spheres are combined at opening 178. The resulting fluid-assisted marking sphere mixture travels into expulsion duct 132 in a substantially vertically downward flow path. After exiting expulsion duct 132, the fluid-assisted marking sphere mixture enters flow diverter 124 which diverts the flow path of the fluid-assisted marking sphere mixture.

Figure 6B:
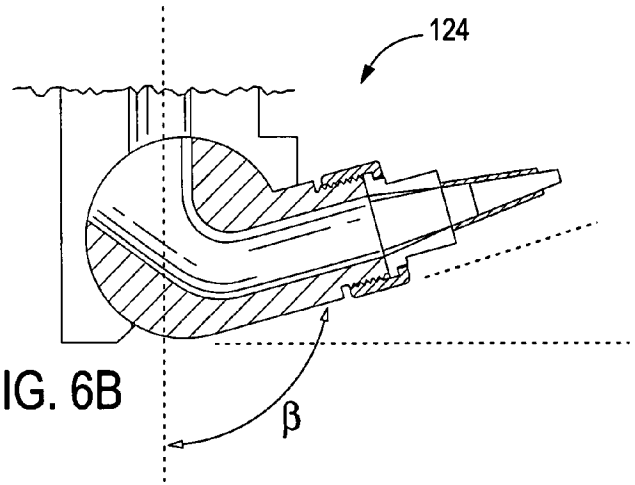
FIG. 6B is a detailed view of a flow diverter along line 2A-2A of FIG. 1 illustrating a first position of the flow diverter according to the marking sphere dispensing apparatus shown in FIG. 1.
Figure 6C:
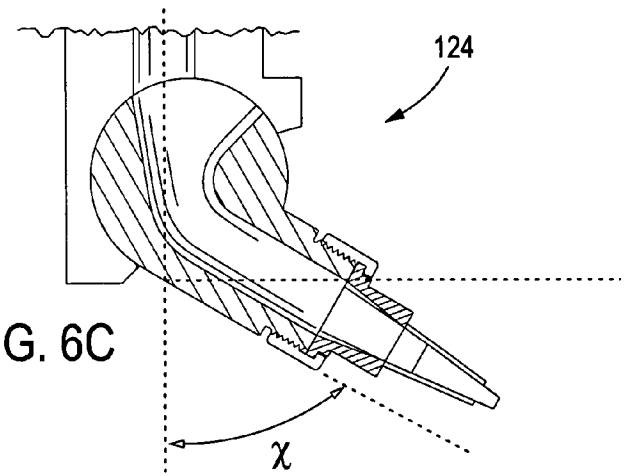
FIG. 6C is a detailed view of a flow diverter along line 2A-2A of FIG. 1 illustrating a second position of the flow diverter according to the marking sphere dispensing apparatus shown in FIG. 1.
Figure 6A:
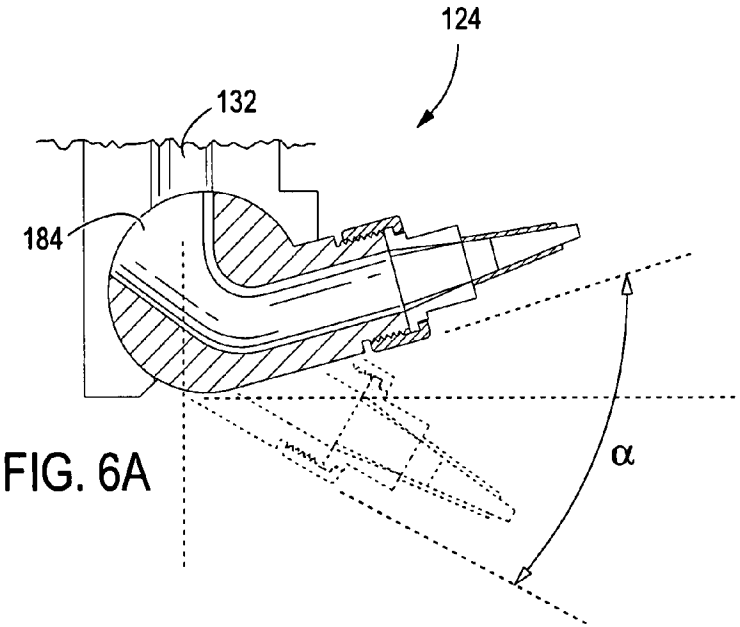
FIG. 6A is a detailed view of a flow diverter along line 2A-2A of FIG. 1 which illustrates a range of motion for the flow diverter according to an embodiment of the marking sphere dispensing apparatus shown in FIG. 1.

FIGS. 6A-6C illustrate the range of angular movement of flow diverter 124 off a downward vertical axis, which is substantially coaxial to the longitudinal axis of an exemplary embodiment of marking sphere dispensing apparatus 100 according to the present invention. FIG. 6A shows flow diverter 124, pivotably attached to expulsion duct frame 126, having an angular range of motion $\alpha$. $\alpha$ may be 0° to less than 180°, and is illustrated in an exemplary embodiment of FIG. 6A to be approximately 45°. Regardless of the size of $\alpha$, flow diverter inlet 184 is of a sufficient size so as to maintain constant fluid communication with expulsion duct 132 throughout the entire range of motion $\alpha$ of flow diverter 124.

FIG. 6B illustrates a first extreme angular position of an exemplary embodiment of flow diverter 124 where flow diverter forms angle $\beta$ from the longitudinal downward vertical of marking sphere dispensing apparatus 100. $\beta$ may be about 90° (substantially perpendicular to the downward vertical) to less than about 180° (slightly less than parallel to the vertical downward, but in the direction of the vertical upward). $\beta$ is illustrated in an exemplary embodiment of FIG. 6B to be approximately 105° from the downward vertical. FIG. 6C illustrates a second extreme angular position of an exemplary embodiment of flow diverter 124 where flow diverter 124 forms angle $\chi$ from the longitudinal downward vertical of marking sphere dispensing apparatus 100. $\chi$ may be 90° (substantially perpendicular to the downward vertical) and is shown in FIG. 6C to be about 60° from the downward vertical.

Figure 9:
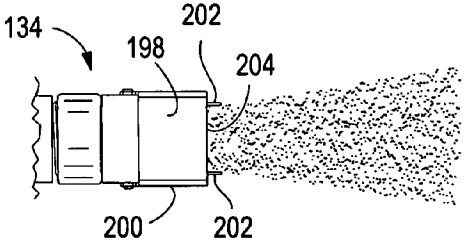
FIG. 9 is a top, detail view showing a discharge funnel and resulting spray pattern of marking spheres flowing from the marking sphere dispensing apparatus shown in FIG. 1.

The fluid-assisted marking sphere mixture exits flow diverter 124 and travels through discharge funnel 134. FIG. 9 is a top view of a discharge funnel 134 according to an embodiment of marking sphere dispensing apparatus 100. The spray pattern of the fluid-assisted marking sphere mixture exiting discharge funnel 134 is determined by the configuration of the components of the discharge funnel 134 as well as the pressure of fluid flow from internal fluid passage 144, the pressure of the marking sphere supply, and the stop gap distance that the plunger head 140 is offset from the valve seat 176. Discharge funnel has a top plate 198, a bottom plate 200 (shown in FIG. 1), and movable sides 202, e.g. left and right guide plates, that define a discharge opening 204. By manipulating the distance between left and right guide plates 202 or the distance between top and bottom plates 198 and 200, the spray pattern of the fluid-assisted marking spheres can also be manipulated.

Figure 11:
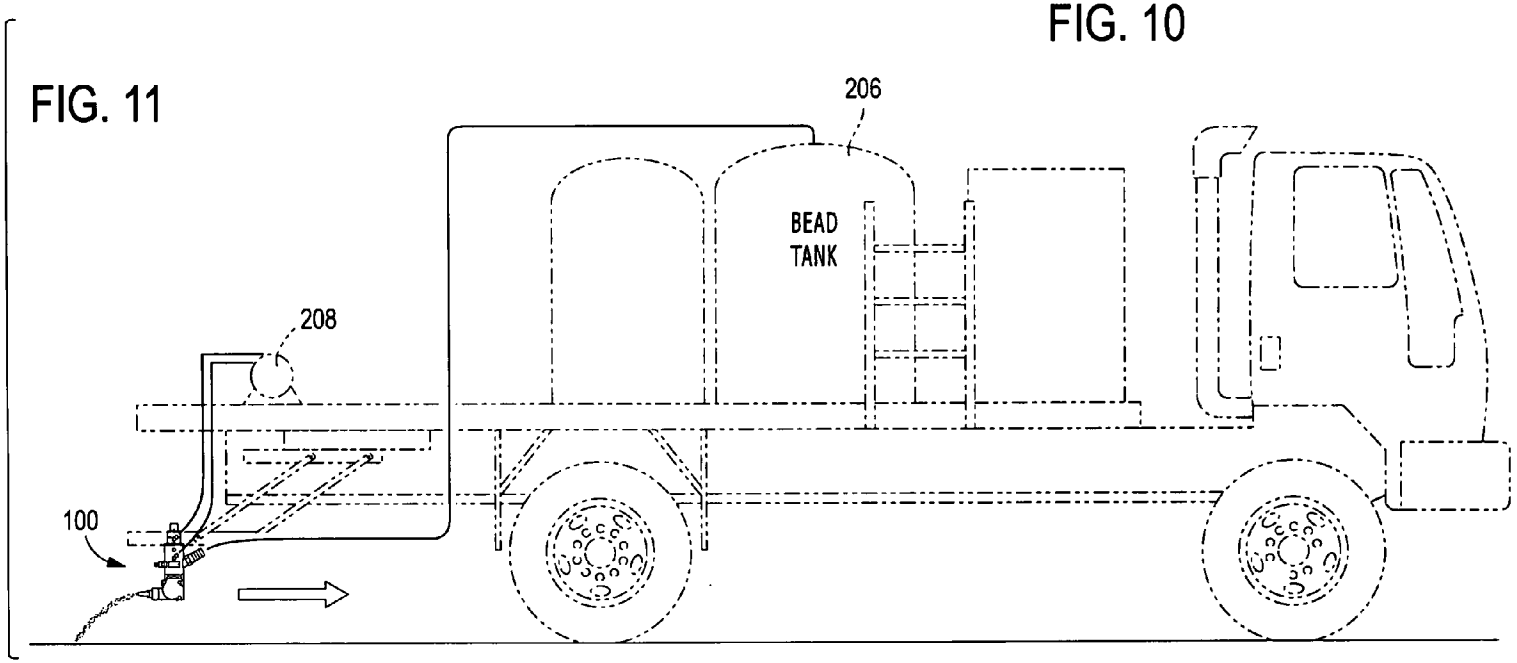
FIG. 11 is a side view of the marking sphere dispensing apparatus shown in FIG. 1 illustrated as mounted on an exemplary application vehicle.

According to an embodiment of the present invention, marking sphere dispensing apparatus 100 may be mounted to an application vehicle as shown in FIG. 11. Carried by the vehicle is a marking sphere reservoir tank 206 to supply marking sphere dispensing apparatus with marking spheres. The vehicle may also carry a compressor 208 to supply marking sphere dispensing apparatus with a continuous supply of pressurized fluid, for example, atmospheric air. As shown in FIG. 11, the vehicle travels in the direction of the arrow and the fluid-assisted marking sphere mixture is applied by marking sphere dispensing apparatus 100 in a direction opposite the direction of vehicle travel.

A method for using an exemplary marking sphere dispensing apparatus to apply marking spheres into the pavement marking material as the pavement marking material is applied to a pavement surface includes providing a supply of marking spheres, pavement marking material, and fluid, either pressurized fluid or fluid fed by gravity, to a marking sphere dispensing apparatus mounted to a vehicle. Pressurized fluid is that fluid supplied by a compressor and has a velocity that is greater than that fluid which is gravity fed. More precisely, a pressurized flow of marking spheres is supplied to a marking sphere dispensing apparatus supported by a frame and having a marking sphere receptacle with a valve seat defining an opening between the marking sphere receptacle and an expulsion duct. The fluid flow is supplied through an internal fluid passage of a plunger of the marking sphere dispensing apparatus. The plunger has a plunger head that when in a first position is seated against the valve seat at which is disposed an internal fluid passage outlet.

Activating a marking sphere dispensing apparatus according to an exemplary method of the present invention occurs when the plunger head is axially offset from the valve seat and the plunger is moved to a second position. At the second position, a marking sphere inlet gap forms across the opening causing the supply of marking spheres in the marking sphere receptacle to mix with the fluid flow, supplied from the internal fluid passage. This marking sphere fluid mixture is expelled into the expulsion duct. Axially offsetting the plunger head is accomplished supplying a pressurized flow of fluid into a first portion of an activation chamber bifurcated by a plunger crown into a first and second portion. The first portion of the activation chamber houses a tension spring. When pressurized fluid pressurizes the second portion of the activation chamber, the plunger crown applies pressure against the tension spring to axially offset the plunger head from the valve seat.

According to an exemplary embodiment of the present invention, the method of using a marking sphere dispensing apparatus includes diverting the substantially vertically downward flow path of the marking sphere fluid mixture as it travels from the expulsion duct through a flow diverter and into a discharge funnel. The flow diverter diverts the downwardly vertical flow to a flow path that is between about 60° to 105° off the downward vertical. After marking sphere fluid mixture is diverted, the mixture exits the marking sphere dispensing apparatus by way of the discharge funnel.

According to an embodiment, the spray pattern, velocity, and volume of the marking sphere fluid mixture exiting the marking sphere dispensing apparatus is adjusted with a control knob. Rotating the control knob defines a stop gap distance between the control knob and the plunger, which stop gap distance is indicative of the distance the plunger head is axially offset from the valve seat. This distance will determine the amount and volume of markings spheres passing from the marking sphere receptacle into the expulsion duct and ultimately effect the spray pattern exiting the dispersion nozzle.

Figure 10:
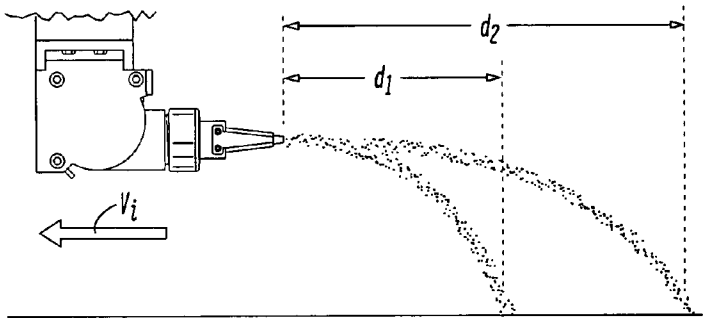
FIG. 10 illustrates different spray patterns of the fluid-assisted marking spheres exiting dispensing portion shown in FIG. 9.

According to other embodiments, the spray pattern, velocity, and volume of the marking sphere mixture can be manipulated by changing the pressure of the marking spheres supplied to the marking sphere receptacle and/or changing the pressure of the fluid flow through the internal passage of the plunger. As illustrated in FIG. 10, the velocity and direction (that is, the vector) of the application vehicle to which the dispensing apparatus is attached is shown by arrow $V_i$. By adjusting the above pressures and distances, the marking sphere fluid mixture will travel a distance relative to the road surface $d_2$. Increasing the relative velocity of the marking sphere fluid mixture negates some of the magnitude of vector $V_i$ of the application vehicle resulting in a decreased distance $d_1$ that the marking spheres travel before impacting the pavement surface.

While embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed:

1. A marking sphere dispensing apparatus comprising:

a frame having a valve seat defining an opening between a marking sphere receptacle and an expulsion duct;

a plunger having a plunger head at one end and moveable in a longitudinal direction within the frame between i) a first position at which the plunger head is seated against the valve seat to close the opening, and ii) a second position at which the plunger head is axially offset from the valve seat to define a marking sphere inlet gap across the opening, wherein the plunger defines an internal fluid passage extending along the length of the plunger for providing a fluid flow and having an outlet at the plunger head, wherein when the plunger is at the second position and the plunger head is axially offset from the marking sphere receptacle valve seat, the fluid flow expelled from the fluid outlet of the plunger head combines with the marking spheres to form a marking sphere fluid flow mixture which is expelled from the marking sphere receptacle into the expulsion duct in a flow path substantially along a longitudinal axis of the dispensing apparatus;

a flow diverter in fluid communication with the expulsion duct and pivotable between a first and second position, wherein the first position is 105° from the longitudinal axis of the dispensing apparatus and the second position is 60° from the longitudinal axis of the dispensing apparatus.

2. The apparatus according to claim 1, wherein the frame further defines an activation chamber having a center coaxial with the longitudinal axis of the plunger so that the plunger extends through the activation chamber.

3. The apparatus according to claim 2, wherein the activation chamber is bifurcated into a first and second portion by a plunger crown.

4. The apparatus according to claim 1, wherein the valve seat is constructed of a material selected from polyurethane or rubber.

5. The apparatus according to claim 4, wherein the material has a Shore A hardness in the range of about 55-60.

6. The apparatus according to claim 1, wherein the marking sphere receptacle has a marking sphere inlet nozzle to accept a flow of marking spheres.

7. The apparatus according to claim 1, wherein the flow of fluid is pressurized or gravity fed.

8. The apparatus according to claim 1, wherein when the plunger is at the first position seated against the valve seat of the marking sphere receptacle, the fluid flow supplied through the internal fluid passage is directed into the expulsion duct and the marking spheres in the marking sphere receptacle are prevented from flowing into the expulsion duct.

9. The apparatus according to claim 3, wherein when the plunger is at the first position, a tension spring, housed within the first portion of the activation chamber, applies pressure against the plunger crown to seat the plunger head against the valve seat.

10. The apparatus according to claim 3, wherein when the plunger is at the second position, pressurized fluid, introduced into the second portion of the activation chamber, applies pressure against the plunger crown which compresses the tension spring housed within the first portion of the activation chamber and axially offsets the plunger head from the valve seat to define the marking sphere inlet gap across the opening.

11. The apparatus according to claim 1, wherein when the plunger is at the first position or the second position, a fluid inlet nozzle provides a flow of fluid passing through the internal fluid passage and exiting the outlet at the plunger head.

12. The apparatus according to claim 1 further comprising a control knob having an internal bore with a base, the control knob positioned at the end opposite the plunger head, wherein a stop gap distance is defined between the base of the control knob and the end of the plunger, which stop gap distance is indicative of a distance between the first and second positions of the plunger.

13. The apparatus according to claim 12, wherein the stop gap distance is indicative of the marking sphere inlet gap formed across the opening through which a volume of marking spheres is permitted to pass.

14. The apparatus according to claim 1, wherein the flow diverter diverts the flow of the fluid-assisted marking sphere mixture from the flow path substantially along the longitudinal axis of the apparatus to a flow path that is between approximately 60° to 105° off the longitudinal axis.

15. The apparatus according to claim 1 further comprising a discharge funnel in fluid communication with the flow diverter and comprising a top plate, a bottom plate, and movable sides to adjust a dispersion pattern of the marking sphere fluid flow mixture as the mixture is dispersed from the dispensing apparatus.

16. The apparatus according to claim 1 further comprising a check valve disposed at the outlet of the internal fluid passage for preventing the flow of marking spheres to the internal fluid passage.

17. A method for applying highway marking spheres onto a substrate with a marking sphere dispensing apparatus comprising the steps of:

supplying a pressurized flow of highway marking spheres into a marking sphere receptacle having a valve seat defining an opening between the marking sphere receptacle and an expulsion duct;

supplying a pressurized fluid flow through an internal passage of a plunger having a plunger head seated, in a first position, against the valve seat at which is disposed an internal passage outlet;

axially offsetting the plunger head from the valve seat into a second position of the plunger wherein a marking sphere inlet gap forms across the opening causing the marking spheres to mix with the pressurized fluid flow and be expelled from the marking sphere receptacle into the expulsion duct in a flow path substantially along the longitudinal axis of the dispensing apparatus; and pivoting a flow diverter in fluid communication with the expulsion duct between a first and second position, wherein the first position is 105° from the longitudinal axis of the dispensing apparatus and the second position is 60° from the longitudinal axis of the dispensing apparatus.

18. The method of claim 17, wherein the step of axially offsetting the plunger head comprises the step of supplying a pressurized flow of fluid into a first portion of an activation chamber bifurcated by a plunger crown, the activation chamber having a second portion housing a tension spring, wherein the pressurized fluid applies pressure against the plunger crown to compress the tension spring to axially offset the plunger head from the valve seat.

19. The method of claim 17 further comprising the step of adjusting a spray pattern of the marking sphere pressurized fluid mixture exiting the marking sphere dispensing apparatus with a control knob.

20. The method of claim 19, wherein the adjusting step comprises rotating a control knob to define a stop gap distance between the control knob and the plunger, which stop gap distance is indicative of a distance the plunger head is axially offset from the valve seat.

21. The method of claim 19, wherein the adjusting step further comprises manipulating at least one of the inlet gap formed across the opening, the pressurized fluid flow through the internal passage, and the pressurized flow of marking spheres into the marking sphere receptacle to effect at least one of a spray pattern of the pressurized fluid marking sphere mixture, a volume of marking spheres in the pressurized fluid marking sphere mixture, and a velocity of the pressurized fluid marking mixture exiting the marking sphere dispensing apparatus.

* * * * *